US006261391B1

(12) United States Patent
Ikeda et al.

(10) Patent No.: US 6,261,391 B1
(45) Date of Patent: Jul. 17, 2001

(54) ALUMINUM ALLOY PLATE FOR SUPER PLASTIC MOLDING CAPABLE OF COLD PRE-MOLDING, AND PRODUCTION METHOD FOR THE SAME

(75) Inventors: Hideaki Ikeda; Masanori Kosugi; Shizuo Kimura, all of Saitama-ken; Mamoru Matsuo, Tokyo; Tsutomu Tagata, Tokyo; Nobuyuki Matsumoto, Tokyo, all of (JP)

(73) Assignees: Honda Giken Kogyo Kabushiki Kaisha; Sky Aluminum Co., Ltd., both of Tokyo (JP)

( * ) Notice: Subject to any disclaimer, the term of this patent is extended or adjusted under 35 U.S.C. 154(b) by 0 days.

(21) Appl. No.: 08/401,719

(22) Filed: Mar. 10, 1995

(30) Foreign Application Priority Data

May 11, 1994 (JP) ..... 6-097613

(51) Int. Cl.[7] ..... C22F 1/04

(52) U.S. Cl. ..... 148/552; 148/564; 148/691; 148/692; 148/695; 148/696; 148/440

(58) Field of Search ..... 148/552, 564, 148/691, 692, 695, 696, 440; 420/542, 543, 544, 545, 546, 547, 549, 552, 553, 902

(56) References Cited

U.S. PATENT DOCUMENTS 5,181,969 * 1/1993 Komatsubara et al. ..... 148/552
5,540,791 * 7/1996 Matsuo et al. ..... 148/552

FOREIGN PATENT DOCUMENTS 57-152453 9/1982 (JP) .
59-28554 2/1984 (JP) .
60-238460 11/1985 (JP) .
62-7836 1/1987 (JP) .
2-285046 11/1990 (JP) .
6-240395 8/1994 (JP) .

* cited by examiner

*Primary Examiner*—Deborah Jones
*Assistant Examiner*—Robert R. Koehler
(74) *Attorney, Agent, or Firm*—Carrier, Blackman & Associates, P.C.; Joseph P. Carrier; William D. Blackman

(57) ABSTRACT

The present invention disclosed is an aluminum alloy plate for super plastic molding capable of cold pre-molding before super plastic molding. The alloy plate comprises Mg at from 2.0 to 8.0% (weight %, the same shall apply hereinafter) Be at from 0.0001 to 0.01%, at least one of Mn at from 0.3 to 2.5%, Cr at from 0.1 to 0.5%, Zr at from 0.1 to 0.5% and V at from 0.1 to 0.5%. Additionally, the alloy plate may comprise an Fe amount and an Si amount each within a range of 0.0 to 0.2%; amounts of Na and Ca within ranges of 3 ppm or less and 5 ppm or less, respectively; while the remainder of the alloy plate consists of Al and inevitable impurities. The resulting alloy plate a crystalline structure is a non-recrystallized crystal structure; the 90° critical bending radius is 7.5 times the plate thickness or less; and the yield strength ratio before and after the final annealing is 70% or more. The invention also discloses production methods for the alloy plate.

11 Claims, 2 Drawing Sheets

( ) is carried out according to necessity.

( ) is carried out according to necessity.

( ) is carried out according to necessity.

ALUMINUM ALLOY PLATE FOR SUPER PLASTIC MOLDING CAPABLE OF COLD PRE-MOLDING, AND PRODUCTION METHOD FOR THE SAME

BACKGROUND OF THE INVENTION

1. Field of the Invention

The present invention relates to an aluminum alloy for super molding, which is subjected to super plastic processing in a temperature range of, for example, from 350 to 560° C., and to a production method for the same.

2. Description of the Related Art

Various materials have so far been investigated which are stretched to a notably large extent without causing local deformation such as necking when they are heated to a prescribed temperature and pulled. In recent years, with respect to an aluminum alloy, super plastic materials which are elongated by 150% or more at, for example, 350° C. or higher are investigated.

Known as a conventional aluminum series super plastic materials are, for example, an Al-78% Zn alloy, an Al-33% Cn alloy, an Al-6% Cu-0.4% Zr alloy, (SUPRALL), an Al—Zn—Mg—Cu alloy (7475 alloy and 7077 alloy of AA standard), and an Al-2.5 to 6.0% Mg-0.05 to 0.6% Zr alloy. Molding processing of a complicated form can readily be made with such super plastic materials.

With respect to JIS No. 5000 series alloys such as an Al—Mg series alloy, it has been confirmed by the present inventors that not only the Al-2.5 to 6.0% Mg-0.05 to 0.6% Zr alloy described above but also other alloys can be used as super plastic molding materials of a so-called static recrystallized type by adequately controlling the production process and adjusting the recrystallization grain size in super plastic molding so that it becomes markedly fine as well as by adequately adjusting the component composition. These are disclosed in Japanese patent application No. 5-47431.

Meanwhile, plastic materials of the discussed type are considered to be applicable to various fields since they provide excellent molding performance at prescribed temperatures. Also with respect to aluminum series super plastic materials, they are considered to be applicable to those fields requiring complicated forms as various structural materials for, for example, automobiles and vehicles such as streetcars. In the case where they are used as structural materials as described above, requirements not only from the viewpoint of facility in molding but also in terms of strength have to be sufficiently considered.

However, conventional aluminum series super plastic molding materials involve the following problems. That is, they can be molded to complicated forms but in the case where they are locally stretched to a large extent, the plate thickness of this stretched part becomes too thin, which causes a deficiency in the structural strength, and they can not be used as structural materials.

Accordingly, it is considered that preliminary molding (hereinafter referred to as pre-molding) is given in advance by cold press molding prior to super plastic molding to make a rough form and then, molding to a complicated form is carried out by the super plastic molding. Local stretching and thinning generated in the super plastic molding can be avoided by such molding. However, it is problematic to perform cold pre-molding before the super plastic molding because such pre-molding lowers the super plastic characteristic to a large extent or the pre-molding itself becomes very difficult to perform with rolled plates of Al—Mg series super plastic molding aluminum alloys of the conventional static recrystallized type as described above.

That is, in the case where the rolled plate of the Al—Mg series super plastic molding aluminum alloy of the conventional static recrystallized type is subjected to super plastic molding, two methods are generally available as described below. The first one is a method in which a plate after rolling is subjected to recrystallization processing and then to super plastic molding at a prescribed super plastic temperature range. The second one is a method in which a rolled plate is put in an oven to complete recrystallization while heating it up to a super plastic molding temperature.

In the first method described above, while a soft plate having recrystallized crystals is subjected to pre-molding, the pre-molding itself is easy, but cold distortion is caused during the pre-molding, and crystal particles are partially coarsened at a super plastic temperature to largely reduce the super plastic molding characteristic.

Meanwhile, in the second method described above, since a plate prior to being recrystallized is subjected to cold pre-molding, the bending performance of the plate is poor in the pre-molding, and the cold pre-molding is usually difficult, which makes even simple bend molding impossible.

The present invention was completed to overcome the above problems of known super plastic materials and methods of molding same. The present invention is made to provide an Al—Mg series aluminum alloy for super plastic molding which has made cold pre-molding actually possible without damaging the super plastic characteristic.

The present inventors repeated various experiments and investigations on the Al—Mg series aluminum alloy for super plastic molding. The results thereof have led to the finding that appropriately adjusting the component composition of the alloy and properly setting and adjusting production conditions allows a crystalline structure to comprise a non-recrystallized structure, a 90° bending radius to become 7.5 times (hereinafter referred to as 7.5 t) or less of a plate thickness and a yield strength ratio before and after annealing (yield strength after annealing/yield strength before annealing) to be set to 70% or more, whereby the problems described above can be solved.

The present invention has been completed based on such knowledge.

SUMMARY OF THE INVENTION

The present invention relates to an aluminum alloy plate for super plastic molding capable of cold pre-molding. The component composition thereof contains Mg 2.0 to 8.0% (weight %, the same shall apply hereinafter) and Be 0.0001 to 0.01%. Further, contained therein is at least one of Mn 0.3 to 2.5%, Cr 0.1 to 0.5%, Zr 0.1 to 0.5% and V 0.1 to 0.5%. In addition, the Fe amount and the Si amount are each set at 0.2% or less, and those of Na and Ca are set to 3 ppm or less and 5 ppm or less, respectively, with the remainder comprising Al and inevitable impurities. The alloy of the invention is an aluminum alloy plate for super plastic molding capable of cold pre-molding, in which the crystalline structure is a non-recrystallized structure and the 90° critical bending radius is 7.5 times (as described above, hereinafter referred to as 7.5 t) or less and in which the yield strength ratio before and after the final annealing is 70% or more.

In the present invention, the composition is the same as that described above, and the alloy is cast in the composition described above. In rolling the cast alloy to the final plate thickness, the cold rolling rate at the final stage is set to 50% or more. The rolled plate of the final plate thickness is subjected to final annealing in which it is heated to within a range of 70 to 150° C. at a temperature-elevating speed of 10° C./min or less, and after maintaining it at the elevated temperature for 0.5 to 12 hours, it is cooled at a cooling speed of 10° C./min or less. This provides the aluminum alloy plate for super plastic molding capable of cold pre-molding, wherein the crystalline structure is a non-recrystallized structure and the 90° critical bend radius is 7.5 times or less a plate thickness and wherein the yield strength ratio before and after the final annealing is 70% or more.

Further, in the present invention, the composition is the same as that described above, and an alloy is cast in the composition described above. In rolling this cast alloy to the final plate thickness, the cold rolling rate at the final stage is set to 50% or more. Further, the rolled plate of the final plate thickness is subjected to the final annealing in which it is heated to within a range of from 150 to 250° C. at a temperature elevating-speed of 1° C./sec or more, and after maintaining it for a holding time of from 0 to 5 minutes, it is cooled at a cooling speed of 1° C./sec or more. This method provides the aluminum alloy plate for the super plastic molding capable of the cold pre-molding, wherein the crystalline structure is a non-recrystallized structure and the 90° critical bend radius is 7.5 times or less and wherein a yield strength ratio before and after the final annealing is 70% or more.

According to the present invention, the super plastic aluminum alloy plate capable of the cold pre-molding before the super plastic molding can be obtained without adversely affecting a super plastic characteristic thereof. This eliminates inconveniences such as problems in terms of strength deficiency attributable to local thinning even in case the plate is used as a structural material. By employing the super plastic aluminum alloy plate according to the present invention, the cold pre-molding maybe carried out without difficulty before the super plastic molding to precedently mold the plate to a certain form and then, the super plastic molding is carried out to mold a complicated part. Using the aluminum alloy plate for the super plastic molding according to the present invention, the applicable fields for the super plastic molding can be largely expanded.

DETAILED DESCRIPTION OF PREFERRED EMBODIMENTS

Figure 1:
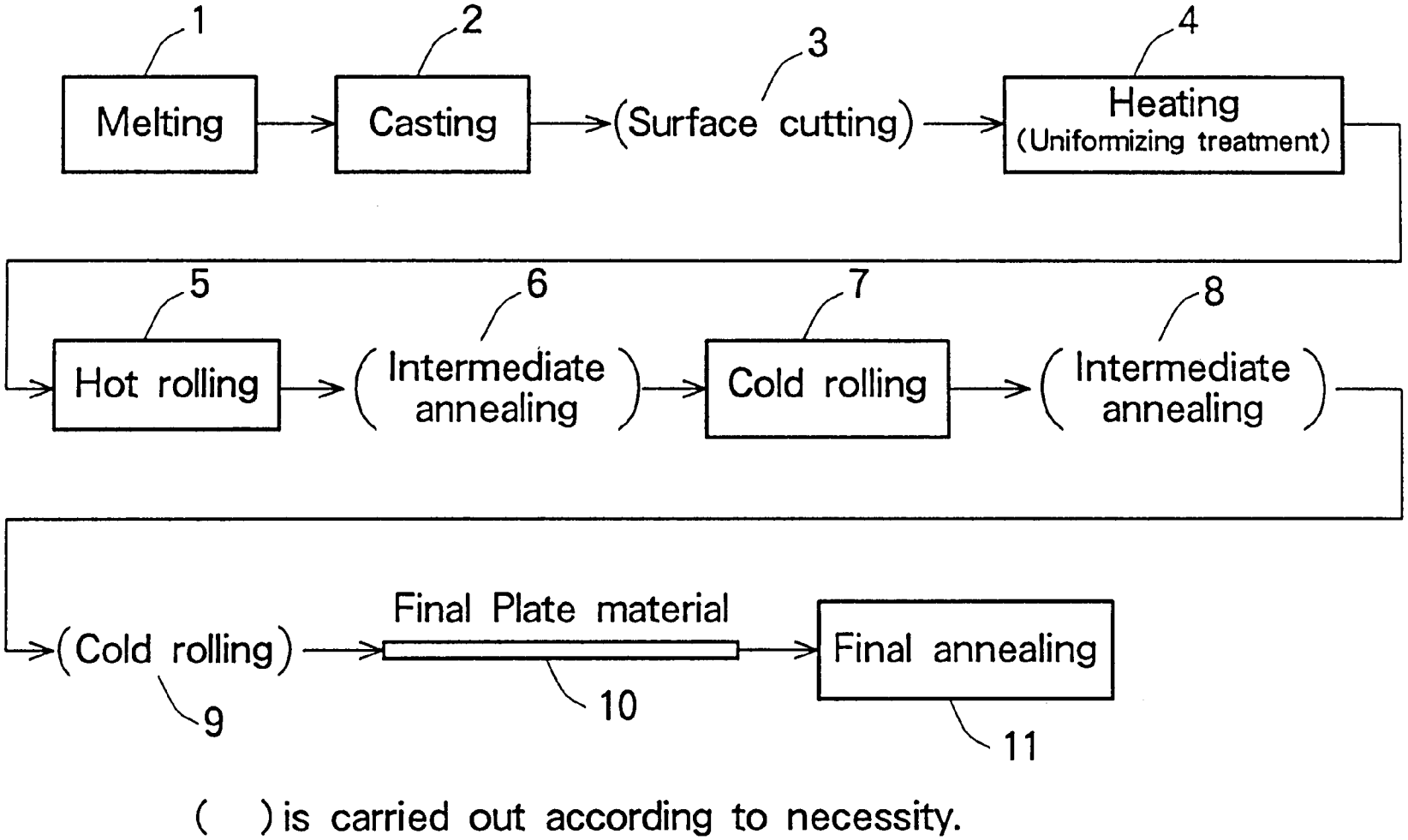
FIG. 1 is a process block diagram showing one example of a semi-continuous casting method as one example of production methods according to the present invention.

Next, preferred embodiments of the present invention will be explained in detail.

First of all, an outline of the present invention will be given.

First, the component composition of a preferred aluminum alloy according to the invention contains Mg 2.0 to 8.0% (weight %, the same shall apply hereinafter) and Be 0.0001 to 0.01%. Further, contained therein is at least one of Mn 0.3 to 2.5%, Cr 0.1 to 0.5%, Zr 0.1 to 0.5% and V 0.1 to 0.5%. In addition, the Fe amount and the Si amount each are set to 0.2% or less, and those of Na and Ca are set to 3 ppm or less and 5 ppm or less, respectively, with the remainder comprising Al and inevitable impurities. The alloy of the invention is an aluminum alloy plate for super plastic molding capable of cold pre-molding, in which the crystalline structure is a non-recrystallized structure and the 90° critical bend radius is 7.5 times (as described above, hereinafter referred to as 7.5 t) or less, and in which the yield strength ratio before and after the final annealing is 70% or more.

According to one preferred method, the composition is the same as that described above, and in rolling the cast alloy to a final plate thickness, the cold rolling rate at the final stage is set to 50% or more. The rolled plate of the final plate thickness is subjected to final annealing in which it is heated to within a range of from 70 to 150° C. at a temperature-elevating speed of 10° C./min or less, and after maintaining it for from 0.5 to 12 hours, it is cooled at a cooling speed of 10° C./min or less. This production method provides an aluminum alloy plate for super plastic molding capable of cold pre-molding, wherein the crystalline structure is a non-recrystallized structure and the 90° critical bend radius is 7.5 times or less and wherein the yield strength ratio before and after the final annealing is 70% or more.

According to another preferred method, the composition is again the same as that described above, and in rolling the cast alloy to a final plate thickness, the cold rolling rate at the final step is set to 50% or more. Further, the rolled plate of a final plate thickness is subjected to final annealing in which it is heated to within a range of from 150 to 250° C. at a temperature-elevating speed of 1° C./sec or more, and after maintaining it for from 0 to 5 minutes, it is cooled at a cooling speed of 1° C./sec or more. This production method also provides an aluminum alloy plate for super plastic molding capable of cold pre-molding, wherein the crystalline structure is a non-recrystallized structure and the 90° critical bend radius is 7.5 times or less and wherein the yield strength ratio before and after the final annealing is 70% or more.

The reasons for limiting amounts of the various components described above in the aluminum alloy for the super plastic molding according to the present invention will be explained below.

Mg: Mg has the functions of:

(1) fining crystal particles generated at a recrystallizing step during the elevating of the temperature for super plastic molding after carrying out cold pre-molding, and improving the super plastic characteristic, and (2) improving the strength and the super plastic molding property without damaging the corrosion resistance and the weldability of a material.

The amount of Mg is set to within a range of 2 to 8% because an Mg amount of less than 2% makes the super plastic molding property insufficient, and an Mg amount exceeding 8% deteriorates both the hot rolling property and the cold rolling property making production difficult, which in turn leads to the deterioration of the cold pre-molding property. Accordingly, the content of Mg has been set to within the range of 2 to 8%.

Be: in general, Be is added for preventing the oxidation of Mg in molten metal. In the case of the present invention, Be has been added for the additional purpose of obtaining an anti-cavitation effect of a rolled-plate therewith.

That is, since Be forms a minute oxide film on the surface of molten metal, hydrogen is prevented from penetrating into the plate, and hydrogen would otherwise cause cavitation of the rolled plate if it penetrated thereinto.

The generation of the cavitation not only causes an undesirable the reduction of super plastic elongation but also causes deterioration of the mechanical properties and the corrosion resistance of a product after super plastic molding.

Further, Be suppresses the oxidation of Mg on a surface of a rolled plate to stabilize the surface. That is, since the super plastic molding is carried out at a high temperature of from 350 to 560° C., an increased Mg amount as is the case with the present invention causes heavy oxidation on the surface in the super plastic molding and is liable to allow the surface to be blackened. However, the addition of Be controls the oxidation on the plate surface in the super plastic molding to stabilize the product surface and resist blackening thereof.

The addition amount of Be is preferably set to within a range of from 0.0001 to 0.01%. The reason therefor is that a Be amount of less than 0.0001% (1 ppm) does not provide the effect described above and an amount exceeding 0.01% (100 ppm) saturates the effect, and in addition thereto, inconveniences arise in terms of toxicity and profitability. Accordingly, the addition amount of Be has preferably been set to within the range of 0.0001 to 0.01%.

Mn, Cr, V and Zr: these elements are effective for fining recrystallized crystal grains generated at the temperature elevation step for the super plastic molding and preventing crystal grains from extraordinarily coarsening. Accordingly, at least one selected from these is added.

With respect to the addition amounts of Mn, Cr, V and Zr, that of Mn of less than 0.3% and those of Cr, V and Zr each being less than 0.1% do not sufficiently provide the effect described above. Meanwhile, that of Mn of not less than 2.5% and those of Cr, V and Zr each exceeding 0.5% generate coarse intermetallic compounds and make the super plastic molding difficult. Accordingly, the amount of Mn has been set to within the range of 0.3 to 2.5%, and those of Cr, V and Zr to within the range of 0.1 to 0.5%, respectively.

Fe, Si, Cu, Zn and the like are contained in normal aluminum alloys as impurities. Of these, particularly Fe has a serious influence on the alloy of the present invention. Accordingly, it has to be controlled as follows:

Fe: Fe allows intermetallic products such as Al—Fe, Al—Fe—Mn(—Si) and Al—Fe—Si to be crystallized. These products cause cavitation in the super plastic molding and thus cause a reduction in the super plastic elongation. The presence of the cavitation deteriorates the mechanical properties, fatigue characteristics and the corrosion resistance of a product as described above. Accordingly, the smaller the amount of Fe, the more preferred it is.

Fe influences the deposition of Mn to some extent, and an increased amount of Fe expedites the crystallization of coarse intermetallic compounds. Accordingly, in order to avoid these adverse influences attributable to Fe, the Fe amount is required to be controlled to less than 0.2%.

Si: Si also allows intermetallic products such as $Mg_2Si$, Al—Fe—Mn—Si and Al—Fe—Si to be crystallized. They cause the cavitation in the super plastic molding to cause a reduction of the super plastic elongation. The presence of cavitation deteriorates the mechanical properties, fatigue characteristics and the corrosion resistance of a product as described above. Accordingly, the smaller the amount of Si, the more preferred it is. In order to avoid these adverse influences attributable to Si, the amount of Si has to be regulated to less than 0.2%.

Na and Ca: Na and Ca are segregated in a recrystallized crystal grain area in the super plastic molding and prevent the super plastic molding from decelerating the generation of cavitation. Amounts of Na and Ca exceeding 3 ppm and 5 ppm, respectively, markedly provide the adverse effects thereof. Accordingly, Na and Ca are regulated to 3 ppm or less and 5 ppm or less, respectively.

With respect to the other elements, since more Cu makes hot rolling difficult, Cu is controlled preferably to less than 0.3%. Zn, as other impurities, in an amount which is 0.5% or less, does not particularly damage the characteristics of the aluminum alloy of the present invention. Accordingly, a Zn content of 0.5% or less is allowable.

In producing the aluminum alloy plate for the super plastic molding according to the present invention, Ti is usually added for fining an ingot structure singly or in combination with B or C before or during casting.

In this case, since an amount of Ti exceeding 1.5% allows for coarse primary crystal grains of $TiAl_3$ to be crystallized and excerts an adverse effect on the super plastic molding property, the Ti amount falls preferably within a range of 0.15% or less.

B and C, if either or both of these are added under coexistence with Ti, they promote further fining and uniformizing of crystal grains. An amount of B exceeding 0.05% generates $TiB_2$ grains, and an amount of C exceeding 0.05% generates graphite grains. In either case, an adverse effect is exerted on the super plastic molding.

Accordingly, B and C which are added in combination with Ti each are set preferably to 0.05% or less.

A chemical component composition of the aluminum alloy plate for the super plastic molding according to the present invention may satisfy the conditions described above. In order to make cold pre-molding before super plastic molding possible, it is important that the non-crystalline structure is formed in terms of not only a component composition of an alloy but also a metal structure.

That is, in the case of a plate which has a recrystallized structure, when cold pre-molding is performed it causes various kinds of cold distortion, and heating this up to a super plastic molding temperature of 350 to 560° C. causes coarsening of crystal grains, which not only reduce the super plastic molding characteristic but also make a performance of a product insufficient.

On the contrary, in case of a non-crystalline plate structure, performing the cold pre-molding and heat treatment at a super plastic molding temperature does not cause a coarsening of crystal grains. Rather, fine recrystallized crystal grains are generated in the course of elevating the temperature for super plastic molding which contribute to the super plastic molding to provide a good super plastic molding property.

Next, the aluminum alloy for the super plastic molding according to the present invention is required to have a cold bending property in which a critical bending radius is 7.5 t. That is, in order to carry out the cold pre-molding, it is required to have a cold moldability. In general, an Al—Mg series alloy which is a target in the present invention is very fragile and has a large critical bend radius in a cold processing condition. It can not even endure slight cold pre-molding and is ruptured in some cases.

In order to make cold pre-molding readily enforceable, the larger the elongation, the better. If the cold bending property is not 7.5 t or less, it can not be said that cold pre-molding is possible.

Accordingly, in the present invention, the cold bending property has been regulated to 7.5 t or less to make it suitable for cold pre-molding.

Naturally, it is important that a super plastic characteristic after the cold pre-molding is not lowered. In addition, less cavitation after molding as well as plastic elongation is important for the super plastic characteristic.

In the case in which a material of a recrystallized crystalline structure is subjected to cold pre-molding, distortion in cold pre-molding causes abnormal growth of crystal grains when the temperature is raised to the next super plastic molding temperature, and the super plastic characteristic is completely lost. Conversely, if the material has a non-recrystalline structure in the cold pre-molding, the crystal grains will not abnormally grow when the temperature is raised to the next super plastic molding temperature.

However, also in this case, although improvement in the bending property may be achieved by final annealing, it also causes recrystallized crystal grains to be gradually grown, shows a tendency to deteriorate a super plastic performance when the temperature is elevated to the super plastic molding temperature after the cold pre-molding and increases cavitation. This deterioration of the super plastic performance and the increase in the cavitation become notable when a yield strength ratio before and after the final annealing (yield strength after annealing/yield strength before annealing) becomes less than 70%.

Accordingly, the yield strength ratio before and after the final annealing has been set to 70% or more to make it suitable for the super plastic characteristic.

Next, a method for producing the aluminum alloy for the super plastic molding will be explained.

In general, a semi-continuous casting method (DC casting method) and a sheet-metal continuous casting methods (for example, a roll cast method) are used as the methods to produce an aluminum alloy plate.

One example of the methods to produce the aluminum alloy plate for super plastic molding by the semi-continuous casting method (DC method) will be explained in order of the processes with reference to a process block diagram shown in FIG. 1.

First of all, a material of the component composition adjusted as described above is melted (1) to make a molten alloy, and this is cast (2) to prepare an alloy ingot. Ti described above may be added as an ingot structure fining agent to the molten metal singly or together with B or C before or during casting.

The ingot thus obtained maybe subjected to surface cutting as shown in the process 3 according to necessity, and subsequently, the ingot is subjected to heat treatment (uniformization treatment) as shown in the process 4. Usually, the heat treatment is carried out by maintaining the ingot at a temperature of from 400 to 560° C. for from 0.5 to 24 hours.

This heating of the ingot may be carried out in one stage serving both as uniformization and pre-heating before hot rolling or may be carried out in two stages separating them.

The heated ingot is subjected to hot rolling by an ordinary method as shown in the process 5, and then, it is subjected to cold rolling as shown in the process 7 to get a prescribed final plate thickness, whereby a plate material having the final plate thickness is obtained as shown in the stage 10.

In this case, intermediate annealing may be carried out once or twice at an interval of the process 5 and the process 7 and in the middle of the cold rolling 7 and stage 10 as shown by the process 6 or the process 8. The conditions of this intermediate annealing are not particularly restricted, and in case of the intermediate annealing using a batch system, it is carried out preferably at a temperature of from 250 to 450° C. for from 0.5 to 12 hours, and in case of continuous annealing, at a temperature of from 400 to 550° C. for from 0 to 30 seconds. A secondary cold rolling process 9 may be interposed according to necessity between the intermediate annealing 8 carried out after the cold rolling 7 according to necessity and the stage 10 in which the final plate material is obtained.

Either batch annealing using an annealing oven of a batch system, or continuous annealing in which annealing is carried out using a continuous annealing oven while allowing a plate drawn out from a coil to continuously run may be employed for the final annealing process 11 to which the final plate material is subjected.

In the case of the preferred production method according to the present invention, a rolling rate in the cold rolling before processing to the final plate thickness has to be set to 50% or more. In the case where the cold rolling is carried out to the final plate thickness without interposing the intermediate annealing, (processes 6 and/or 8) this rolling rate means the whole rolling rate, and in the case where the cold rolling is carried out to the final plate thickness interposing at least once the intermediate annealing, the rolling rate means a cold rolling rate after the final intermediate annealing.

Such rolling rate is necessary because a cold rolling rate of less than 50% before the final plate thickness coarsens recrystallized crystal grains generated at a temperature-elevating step for the super plastic molding and makes it difficult to obtain a sufficient super plastic characteristic. Meanwhile, a cold rolling rate of 50% or more before the final plate thickness can provide the sufficient super plastic characteristic with a fine recrystalline structure in the super plastic molding without coarsening the recrystallized crystal grains.

The rolled plate processed to the final plate thickness is subjected to final annealing in the final annealing process 11 as described above. The final annealing in this final annealing process is necessary to provide the rolled plate obtained with ductility and to adjust so that a cold bending property becomes 7.5 t or less. This final annealing process must be controlled, however, to prevent the recrystallization of a structure, so that the structure remains a non-crystalline structure, to maintain super plastic performance, and such that the yield strength before and after the final annealing is 70% or less.

In the case where batch annealing is carried out as the final annealing process, after heating to a temperature ranging from 70 to 150° C. at a temperature-elevating speed of 10° C./min or less and maintaining such temperature for from 0.5 to 12 hours, cooling is carried out at a cooling speed of 10° C./min or less. In this case, a heating temperature of less than 70° C. and a maintenance time of less than 0.5 hours do not sufficiently improve the ductility thus making cold pre-molding difficult. Meanwhile, a heating temperature exceeding 150° C. deteriorates the super plastic performance. A maintenance time exceeding 12 hours saturates the effect so as to reduce profitability.

In the case where final annealing process is carried out by continuous annealing, after heating to a temperature ranging from 150 to 250° C. at a temperature-elevating speed of 1C/sec or more and maintaining the temperature for from 0 to 5 minutes or less, cooling is carried out at a cooling speed of 1° C./sec or more. In this case, a heating temperature of 150° C. or lower does not sufficiently improve the ductility and makes the cold pre-molding difficult. Meanwhile, a heating temperature exceeding 250° C. or a maintenance time exceeding 5 minutes causes recrystallization and coarsens the crystal grains in the super plastic molding so as to lower a super plastic moldability.

The balance of the state of crystalline structure with the ductility as achieved in the final annealing is actually varied depending also on the specific component composition of the alloy. Accordingly, such optimum conditions that a non-recrystallized crystal structure is maintained within the range of the component composition described above, the yield strength ratio before and after the annealing is 70% or more and that the bending property at room temperature is 7.5 t or less are preferably selected and applied to the conditions actually applied for the final annealing process 11.

Figure 2:
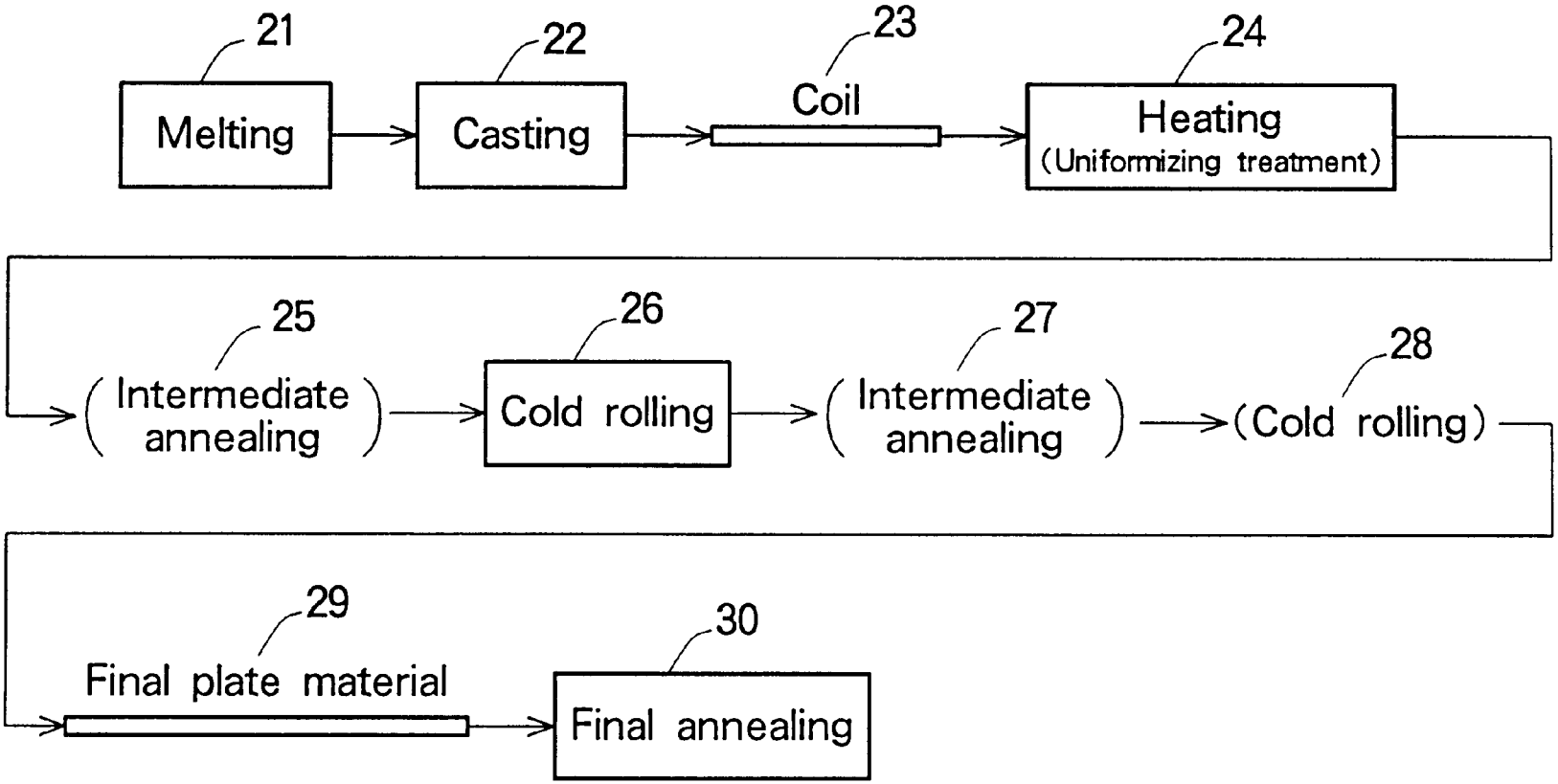
FIG. 2 is a process block diagram showing one example of a sheet-metal continuous casting method as one example of production methods according to the present invention.

FIG. 2 is a process block diagram showing one example of the processes for producing an aluminum alloy plate for super plastic molding by a sheet continuous casting method (roll cast method).

As shown in the diagram, in the sheet continuous casting method, a material having the component composition adjusted as described above is first melted 21 to make molten alloy, and this is cast 22 into cast a sheet material. Then, it is wound to prepare a cast plate coil 23. This cast plate coil 23 is usually subjected to uniformization heating at a temperature of from 400 to 560° C. for from 0.5 to 24 hours in the heating process 24 in this state. Thereafter, cold rolling is carried out in the cold rolling process 26 to obtain a plate material 29 of the final plate thickness. The final plate material 29 obtained in the same manner as that described above is subjected to final annealing in the final annealing process 30.

Intermediate annealing processes 25 or 27 or both are carried out before and after this cold rolling process 26 according to necessity in the same manner as that described above, and if necessary, secondary cold rolling is carried out in the process 28 to finally adjust the plate thickness, whereby the final plate material 29 having a prescribed thickness is obtained.

In this method, since the material is cast in a state of a cast plate coil, a cast material of an aluminum alloy is produced having a thinner plate thickness than that described above in relation to the semi-continuous casting method of FIG. 1. Accordingly, a hot rolling process which is inevitable for the method of FIG. 1 described above in which a material is prepared in ingot form is unnecessary, and this can be omitted in the sheet continuous casting method.

Also in the above sheet continuous casting method, the amount(s) of structure fining agent(s) added to molten metal for a cast plate, the conditions for the intermediate annealing, and the conditions for the final annealing are the same as those in the method described above.

The aluminum alloy for the super plastic molding according to the present invention is obtained in the manners explained above.

The aluminum alloy for the super plastic molding thus obtained, though it is of a non-recrystallized crystal structure, has a relatively good ductility with the bending property of 7.5 t or less at room temperature, and therefore, the cold pre-molding can be carried out prior to super plastic molding.

Usually, the super plastic molding after the cold pre-molding is carried out at a temperature ranging from 350 to 560° C. In the aluminum alloy for the super plastic molding according to the present invention, fine crystals (recrystallization) are generated in a temperature-elevating process up to a super plastic molding temperature region, and coarse crystal grains are not grown. Accordingly, an excellent super plastic molding characteristic can be displayed.

Next, concrete examples of the present invention will be given.

The following Table A shows slabs falling within a range of the component composition according to the present invention and slabs as comparative alloys not falling within the range of the component composition regulated in the present invention, wherein the slabs are cast by a conventional semi-continuous casting method (DC casting method). The slabs were set to a cross-sectional dimension of 450 mm×1300 mm. The alloys 1 to 5 at a front end of the table are the alloys of the present invention that fall within the range of the component composition set in the present invention. The alloy 6 and 7 are the comparative alloys prepared in the component composition not falling within the component composition set in the present invention.

TABLE A

| | Composition | | | | | | | | | | | | |
|---|---|---|---|---|---|---|---|---|---|---|---|---|---|
| Alloy | Mg | Mn | Cr | Zr | V | Fe | Si | Ti | B (ppm) | Be (ppm) | Na (ppm) | Ca (ppm) | |
| 1 | 4.6 | 0.72 | — | — | — | 0.03 | 0.07 | — | — | 10 | — | — | Inventive alloy* |
| 2 | 4.5 | 0.63 | — | 0.18 | — | 0.03 | 0.05 | 0.01 | 4 | 13 | 1 | — | Inventive alloy* |
| 3 | 4.7 | 0.69 | — | — | 0.13 | 0.03 | 0.04 | 0.02 | 8 | 5 | — | — | Inventive alloy* |
| 4 | 4.3 | — | 0.19 | — | — | 0.06 | 0.04 | 0.01 | 5 | 7 | — | — | Inventive alloy* |
| 5 | 4.5 | 0.58 | 0.10 | — | — | 0.02 | 0.03 | 0.02 | 6 | 5 | — | 1 | Inventive alloy* |
| 6 | 4.3 | — | — | — | — | 0.12 | 0.21 | 0.01 | 5 | 0 | — | — | Comparative alloy** |
| 7 | 4.5 | 0.70 | 0.12 | — | — | 0.06 | 0.08 | 0.02 | 6 | 8 | 7 | 5 | Comparative alloy** |

*within the component composition of the present invention
**not within the component composition of the present invention After casting, the respective slabs described above were cut to 12 mm per one plane. Thereafter, they were heated at of 530° C. for 6 hours and then were heated to 480° C. to carry out hot rolling, whereby hot-rolled plates having a plate thickness of 6 mm were obtained. These hot-rolled plates were subjected to cold rolling, and a part of them was subjected to intermediate annealing in the middle of the cold rolling. This allowed them to be finished to a plate thickness of 2 mm (rolling rate: 67%) and then, while excluding a part of them, they were subjected to the final annealing in various conditions by batch annealing or continuous annealing.

The respective conditions in these cold rolling and final annealing are shown with production numbers (lot) in the following Table B.

TABLE B

| Lot | Alloy | Intermediate annealing | Final cold rolling rate | Final annealing (2 t) | |
|---|---|---|---|---|---|
| 1 | 1 | None | 67% | 120° C. × 5 h (BAF) | Invention |
| 2 | 1 | None | 67% | None | Comparison (no final annealing) |
| 3 | 1 | None | 67% | 300° C. × 0 sec (CAL) | Comparison (final annealing: high temperature) |
| 4 | 1 | 350° C. × 2 h (3 t) | 33% | 120° C. × 5 h (BAF) | Comparison (cold rolling rate: small) |
| 5 | 2 | None | 67% | 100° C. × 5 h (BAF) | Invention |
| 6 | 2 | None | 67% | 210° C. × 0 sec (CAL) | Invention |
| 7 | 3 | None | 67% | 100° C. × 5 h (BAF) | Invention |
| 8 | 3 | None | 67% | 50° C. × 5 h (BAF) | Comparison (final annealing: |

TABLE B-continued

| Lot | Alloy | Intermediate annealing | Final cold rolling rate | Final annealing (2 t) | |
|---|---|---|---|---|---|
| | | | | | low temperature) |
| 9 | 4 | None | 67% | 120° C. × 5 h (BAF) | Invention |
| 10 | 4 | None | 67% | 260° C. × 5 h (BAF) | Comparison (final annealing: high temperature) |
| 11 | 5 | None | 67% | 140° C. × 5 h (BAF) | Invention |
| 12 | 6 | None | 67% | 220° C. × 0 sec (CAL) | Comparison (out of the component composition of the present invention) |
| 13 | 7 | None | 67% | 120° C. × 5 h (BAF) | Comparison (out of the component composition of the present invention) |

Next, the respective plates after the final annealing were observed for micro structure at room temperature to check the presence of recrystallized crystals. The 90° critical bending radius was measured in a rolling direction at room temperature.

Further, the respective plates were subjected to cold stretch processing of 5% assuming cold pre-molding. Then, they were heated to 500° C. and were subjected to a super plastic bulge test at the same temperature to measure the super plastic height. The cavitation at a part where a plate thickness reduction rate was ½ (100% relative distortion) was measured at the same time. The pressure in the bulge molding was set to 3 atmospheric pressure, and a bulge height of 50 mm or more was judged as being good. The cavitation was measured in terms of the area ratio after polishing a cross-sectional part of the plate thickness, and a cavitation of 1.5% or less was defined as a good cavitation level.

The above results are shown in the following Table C.

TABLE C

| Lot | Alloy | Final cold rolling rate | Final annealing | Yield strength (MPA)*1 | Yield strength (MPA)*2 | Yield strength ratio | Crystal-line structure*3 | Bend R*4 | Super plastic bulge height | Cavita-tion % |
|---|---|---|---|---|---|---|---|---|---|---|
| 1 (Inv.) | 1 | 67% | 120° C. × 5 h | 392 | 334 | 85.1% | A | 8 mm | 58.2 mm | 0.6 |
| 2 (Comp.) | 1 | 67% | None | 392 | — | — | A | 21 mm | 58.5 mm | 0.5 |
| 3 (Comp.) | 1 | 67% | 300° C. × 0 sec | 392 | 243 | 61.9% | B | 2 mm | 48.2 mm | 2.1 |
| 4 (Comp.) | 1 | 33% | 120° C. × 5 h | 335 | 301 | 90.0% | A | 6 mm | 45.3 mm | 2.3 |
| 5 (Inv.) | 2 | 67% | 100° C. × 5 h | 385 | 360 | 93.5% | A | 9 mm | 59.3 mm | 0.5 |
| 6 (Inv.) | 2 | 67% | 210° C. × 0 sec | 385 | 321 | 83.3% | A | 7 mm | 59.0 mm | 0.5 |
| 7 (Inv.) | 3 | 67% | 100° C. × 5 h | 395 | 367 | 93.0% | A | 9 mm | 60.2 mm | 0.7 |
| 8 (Comp.) | 3 | 67% | 50° C. × 5 h | 395 | 392 | 99.2% | A | 18 mm | 60.2 mm | 0.7 |
| 9 (Inv.) | 4 | 67% | 120° C. × 5 h | 364 | 305 | 84.2% | A | 7 mm | 59.2 mm | 0.9 |
| 10 (Comp.) | 4 | 67% | 260° C. × 5 h | 364 | 228 | 62.5% | B | 0.4 mm | 48.5 mm | 1.8 |
| 11 (Inv.) | 5 | 67% | 140° C. × 5 h | 396 | 322 | 81.3% | A | 6 mm | 57.9 mm | 0.8 |
| 12 (Comp.) | 6 | 67% | 220° C. × 0 sec | 338 | 265 | 78.3% | A | 2 mm | 45.2 mm | 2.5 |
| 13 (Comp.) | 7 | 67% | 120° C. × 5 h | 390 | 330 | 84.6% | A | 9 mm | 49.3 mm | 1.8 |

*1before final annealing
*2after final annealing
*3of the final plate
*4at an ordinary temperature
A: Non-recrystallized crystal
B: Recrystallized crystal As a result thereof, in any of the aluminum alloy plates for the super plastic molding which had a component composition falling within the range set in the present invention and a non-crystalline structure, and in which the bending property at room temperature was 7.5 t (plate thickness: 2 mm; bending radius: 15 mm) or less and a yield strength before and after the final annealing was 70% or more, the moldability at room temperature was good and the cold pre-molding could readily be carried out before super plastic molding. In addition, the super plastic characteristic was good as well.

Seeing a comparative example in which the final annealing was not carried out while the component composition of an alloy fell within the range of the present invention as is the case with the production lot number 2 and a comparative example in which a temperature in the final annealing was too low as is the case with the production lot number 8, it can be understood that in all such cases, the bending property at an ordinary temperature is larger than 7.5 t and the moldability at room temperature is inferior and that the cold pre-molding is difficult.

From a comparative example in which the temperature in the final annealing was too high while the component composition of an alloy fell within the range of the present invention as is the case with the production lot numbers 3 and 10, it can be understood that growth of crystal grains is generated in the super plastic molding to deteriorate a super plastic moldability (bulge height inferior) and that a cavitation characteristic is inferior as well.

Also from a comparative example in which a cold rolling rate before the final annealing is small as is the case with the production lot number 4, it can be understood that since the cold rolling rate is small, sufficient elongation is not obtained in the super plastic molding (bulge height inferior) and that the cavitation characteristic is inferior as well.

The production lot numbers 12 and 13 are the cases in which the component compositions of the alloys did not fall within the range regulated in the present invention. The production thereof was carried out in a production process satisfying the conditions in the present invention but it was found that in these cases, sufficient super plastic elongation was not obtained. Naturally, the cavitation characteristic is inferior as well.

As was explained above in detail, according to the present invention, a super plastic aluminum alloy plate capable of cold pre-molding prior to the super plastic molding can be obtained without reducing or adversely affecting the super plastic characteristic.

Accordingly, the use of the super plastic aluminum alloy plate according to the present invention eliminates the conventional problems in terms of strength attributable to local thinning even where the plate is used as a structural material. Particularly, by using an alloy plate having a composition according to the invention and which is prepared according to the methods of the invention, the cold pre-molding can be reliably performed prior to the super plastic molding to precedently mold the alloy plate to a form of a certain level and then the super plastic molding may be reliably performed to mold a complicated part.

This can largely expand application fields of the super plastic molding.

The present invention provides such an effect.

Although there have been described what are at present considered to be the preferred embodiments of the invention, various modifications and variations may be made thereto without departing from the spirit and essence of the invention. The scope of the invention is indicted by the appended claims rather than by the foregoing description.

What is claimed is:

1. A method for producing an aluminum alloy plate for super plastic molding capable of cold pre-molding from an aluminum alloy containing Mg ranging from 2.0 to 8.0 weight %; Be ranging from 0.0001 to 0.01 weight %; at least one of Mn ranging from 0.3 to 2.5 weight %, Cr ranging from 0.1 to 0.5 weight %, Zr ranging from 0.1 to 0.5 weight % and V ranging from 0.1 to 0.5 weight %; Fe and Si each ranging from 0.0 to 0.2 weight %; Na ranging from 0 to 3 ppm; Ca ranging from 0 to 5 ppm; and a remainder of Al and inevitable impurities: wherein the method comprises the steps of:

casting the aluminum alloy;

rolling the cast alloy to a final plate thickness, said rolling step including setting a cold rolling rate at a final stage to at least 50%; and subjecting the rolled plate of a final plate thickness to final annealing, wherein the rolled plate having the final plate thickness is heated to an elevated temperature within a range of 70 to about 140° C. at a temperature-elevating speed of 10 C./min or less, maintaining the rolled plate at the elevated temperature for 5 to 12 hours, and thereafter cooling the rolled plate at a cooling speed of 10° C./min or less.

2. The method for producing the aluminum alloy plate for the super plastic molding capable of cold pre-molding according to claim 1, wherein said rolling and final annealing steps are effected such that a crystalline structure of the plate is a non-recrystallized crystal structure, a 90° critical bending radius is at least 7.5 times a plate thickness, and a yield strength ratio before and after the final annealing is at least 70%.

3. The method for producing the aluminum alloy plate for super plastic molding capable of cold pre-molding according to claim 1, wherein said aluminum alloy is an ingot;

the method further includes the step of subjecting the cast alloy to uniformizing heat treatment prior to said rolling step; and said rolling step includes hot rolling followed by cold rolling.

4. The method for producing the aluminum alloy plate for super plastic molding capable of cold pre-molding according to claim 3 wherein said uniformizing heat treatment is carried out by maintaining the temperature in a range of 400 to 560° C. for from 5 to 24 hours.

5. The method for producing the aluminum alloy plate for super plastic molding capable of cold pre-molding according to claim 3 further including a step of surface cutting said cast alloy prior to said uniformizing heat treatment step.

6. The method for producing the aluminum alloy plate for super plastic molding capable of cold pre-molding according to claim 3, further including a step of intermediately annealing the alloy between the hot rolling and the cold rolling of said rolling step.

7. The method for producing the aluminum alloy plate for super plastic molding capable of cold pre-molding according to claim 6, wherein said intermediate annealing step includes at least one of batch annealing carried out at a temperature range of 250 to 450° C. for 0.5 to 12 hours and continuous annealing carried out at a temperature range of 400 to 550° C. for from 0 to 30 seconds.

8. The method for producing the aluminum alloy plate for super plastic molding capable of cold pre-molding according to claim 1, including further steps of:

coiling said cast aluminum alloy to form a cast plate coil; and subjecting the cast plate coil to uniformizing heat treatment prior to said rolling step; and said rolling step includes cold rolling said aluminum alloy to produce a rolled plate of the final plate thickness.

9. The method for producing the aluminum alloy plate for super plastic molding capable of cold pre-molding according to claim 8, wherein said uniformizing heat treatment is carried out by maintaining the cast plate coil at a temperature ranging from 400 to 560° C. for 0.5 to 24 hours.

10. The method for producing the aluminum alloy plate for super plastic molding capable of cold pre-molding according to claim 8, further including a step of intermediately annealing the cast plate coil before and after said cold rolling.

11. The method for producing the aluminum alloy plate for super plastic molding capable of cold pre-molding according to claim 10, wherein said intermediate annealing includes at least one of batch annealing carried out at a temperature ranging from 250 to 450° C. for 0.5 to 12 hours and continuous annealing carried out at a temperature ranging from 400 to 550° C. for from 0 to 30 seconds.

* * * * *

UNITED STATES PATENT AND TRADEMARK OFFICE

CERTIFICATE OF CORRECTION

PATENT NO. : 6,261,391 B1
DATED : July 17, 2001
INVENTOR(S) : Ikeda et al.

It is certified that error appears in the above-identified patent and that said Letters Patent is hereby corrected as shown below:

Title page,
Item [57], ABSTRACT, 4th line, after "hereinafter)" insert a comma;
Line 5, after "0.01%," insert -- and --;
Line 12, change "The" to -- In the --.

Column 1,
Line 62, after "extent" insert a comma.

Column 3,
Line 28, change "maybe" to -- may be --.

Column 4,
Line 54, after "undersirable" delete -- the --.

Column 5,
Line 63, change "excerts" to -- exerts --.

Column 6,
Line 55, change "However, also in this case, although" to -- Although --;
Between lines 59 and 60, after "pre-molding" insert a comma.

Column 7,
Line 4, change "methods" to -- method --;
Line 53, change "annealing, (processes 6 and/or 8)" to -- annealing (processes 6 and/or 8), --.

Column 8,
Line 19, after "ductility" insert a comma;
Line 27, change "1C/sec" to -- 1°C/sec --;
Line 50, change "cast 22 into cast" to -- cast 22 into --.

UNITED STATES PATENT AND TRADEMARK OFFICE

CERTIFICATE OF CORRECTION

PATENT NO. : 6,261,391 B1
DATED : July 17, 2001
INVENTOR(S) : Ikeda et al.

It is certified that error appears in the above-identified patent and that said Letters Patent is hereby corrected as shown below:

Column 13,
Lines 30 and 31, change "indicted" to -- indicated --;
Line 43, after "impurities" change the colon to semi-colon;
Line 49, change "a final" to -- the final --;
Line 53, change "10C./min" to -- 10°C/min --.

Signed and Sealed this

Twenty-sixth Day of February, 2002

*Attest:*

*Attesting Officer*

JAMES E. ROGAN
*Director of the United States Patent and Trademark Office*